United States Patent [19]

Vincent De Araûjo

[11] Patent Number: 4,514,716

[45] Date of Patent: Apr. 30, 1985

[54] FUSE

[76] Inventor: Manuel A. Vincent De Araûjo, 73390 Chamoux-sur-Gelon, France

[21] Appl. No.: 403,634

[22] PCT Filed: Nov. 23, 1981

[86] PCT No.: PCT/FR81/00152

§ 371 Date: Jul. 20, 1982

§ 102(e) Date: Jul. 20, 1982

[87] PCT Pub. No.: WO82/01961

PCT Pub. Date: Jun. 10, 1982

[30] Foreign Application Priority Data

Nov. 25, 1980 [FR] France ..... 80 24971

[51] Int. Cl.[3] ..... H01H 85/42

[52] U.S. Cl. ..... 337/281; 337/273

[58] Field of Search ..... 337/281, 282, 273, 1–4; 361/104

[56] References Cited

U.S. PATENT DOCUMENTS 659,671 10/1900 Hewlett ..... 337/281

685,766 11/1901 Jones ..... 337/281

*Primary Examiner*—Harold Broome

*Attorney, Agent, or Firm*—Roland Plottel

[57] ABSTRACT

The fuse comprises an elongated support formed at least partially from ferrite, magnetized in the direction of its thickness and on which is disposed, between two terminals, a metal wire (9) capable of being destroyed by melting. The fuse comprises for example two ferrite strips (5 and 6) assembled together and spaced apart by means of two insulating-material bars (7 and 8), a silver wire (9) being disposed between the two strips. When the wire melts, the molten metal and the electric arc are driven laterally in accordance with the LAPLACE law.

8 Claims, 8 Drawing Figures

FUSE

The present invention relates to a fuse comprising a metal wire capable of being destroyed by melting more especially in the case of an excess current.

Fuses are devices, used already for a very long time, for protecting against excess currents. When the installation or the apparatus to be protected is capable of withstanding an excess current for a short time, such fuses constitute a reliable protection. With the use of electronic circuits, whose components are incapable of withstanding high overcurrents, even for very short times, being more and more widespread, it has proved that such fuses are not always capable of ensuring a sufficient protection for the circuits. This is the case for example for remote data processing circuits connected to transmission lines exposed to overvoltages atmospheric in origin. The best fuses known up to date for protecting such installations are silver-wire fuses enclosed in a glass tube, the wire being possibly stretched by means of a spring so as to ensure immediate breaking of the arc which forms at the moment when the wire breaks. Now even with the best fuses known up to date, the destruction of circuit components can be noted despite the melting of the fuse. This is explained by the vaporization of the molten silver which forms a conducting plasma inside the tube, this plasma maintaining the electric arc, i.e. a high current through the fuse. Generally, this effect may be seen by the blackening of the glass tube.

To ensure blowout of the arc, the use of deflection effects related to the presence of a magnetic field has been proposed in some fuses, this magnetic field being created by permanent magnets or coils associated with the fuse. Thus complex, expensive and bulky structures have been provided in the prior art. More especially, the metal permanent magnets used in the constructions of fuses of the prior art require, on the one hand, the interpositioning of insulating walls between the magnet and the fuse and, on the other hand, the use of bulky magnets. The space occupancy of these magnets, due in particular to the fact that they are necessarily magnetized in the direction of their length, practically rules out the formation of a uniform magnetic field over the whole length of a fuse wire. The interpositioning of insulating walls necessarily increases the air gap or the distance between the pole piece and the fuse, so that the magnetic field is reduced as well as the efficiency of the blowout.

The present invention has as its aim to ensure, by the simplest means possible, the extinction of this arc by blowout. According to one aspect of the invention, the means serving as permanent magnet also serve as mechanical support and as extinction chamber wall. According to another aspect of the invention, the means serving as permanent magnet are magnetized in the direction of their thickness so as to reduce their space occupancy. According to other aspects of the invention, the magnetic field is produced over the whole length of the fuse wire so as to increase the mechanical stress produced in the wire and ensure blowout of the arc whatever the breakage point of the wire; the magnetic field is produced over a sufficient width on each side of the fuse wire to allow a substantially elongation of the arc and acceleration of blowout.

In its simplest form, the fuse of the invention is formed by an elongated ferrite support magnetized in the direction of its thickness and on which is disposed a non-ferromagnetic conductorfuse wire between two terminals. According to the LAPLACE law, when the wire has a current passing therethrough, in one direction or in the other, it is subjected to a force perpendicular to the wire and parallel to the ferrite support plane and this force is proportional to the product of the current and of the magnetic field. It should be noted that this force acts on any moving eletric charge, i.e. also on the electric arc likely to form at the breakage point of the wire. This force not only results in magnetically blowing out the electric arc, but in accelerating the breakage of the wire at the point thereof weakened by melting and in accelerating the separation of the strands at the breakage point, i.e. reducing the time during which an arc is likely to form.

According to a practical embodiment, the fuse is formed of two strips of flexible ferrite, formed from ferrite powder bonded by means of an elastomer, fixed at a small distance from one another by means of two insulating bars, the fuse wire being housed between the two ferrite strips. The electric insulating qualities of ferrites allow a very thin air gap to be formed in which the magnectic field is high. Furthermore, the effect of transverse blowout of the arc prevents the projection of conducting material on the nearby ferrite walls, which projections would tend to prolong the existence of the arc.

The part of the insulating bar situated between the ferrite strips is preferably provided with teeth, in the manner of a comb, so as to form gaps forming cooling and transverse extinction chambers in which the arc is broken up into fragments and magnetically blown out. If it is desired to avoid the projection of metal outwardly through these holes, these latter may be covered by means of an adhesive strip. The use of multiple cooling and transverse extinction chambers in relationship with the magnetic blowout allows a considerable extension of the path of the arc for a given transverse dimension of the device, whereas the multiple cooling chambers of the prior art, not associated with magnetic blowout, only allow limited breaking up into fragments and expansion of the molten material. Thus a very rapid fuse is obtained with very high cut-off power.

According to another aspect of the invention, the teeth forming the transverse walls of the cooling chambers also serve as an intermediate mechanical support for the fuse wire, the wire being nipped between the opposite teeth.

The terminals may be formed in different ways, for example by means of rings or by magnetized plugs nipping the ends of the wire.

The enclosed drawing shows, by way of example, a few embodiments of the invention.

Figure 1:
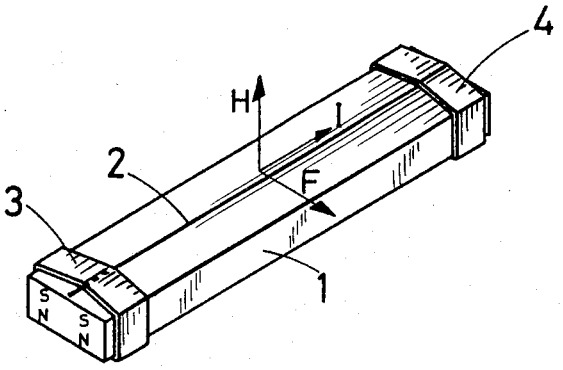
FIG. 1 is a perspective view of a first, and simplest, embodiment of the invention.

FIG. 1 illustrates simultaneously the principle of the invention and the simplest embodiment thereof. On a thin ferrite slab 1 magnetized in the direction of its thickness so as to present north poles on its lower face and south poles on its upper face, is fixed a silver wire 2 by means of two metal rings 3 and 4 which form the terminals of the fuse. Wire 2 has, for example, a diameter of 0.1 mm and a length of 30 mm. According to the LAPLACE law, when this wire has a current I passing therethrough, it is subjected to a force F under the effect of the magnetic field H.

Figure 2:
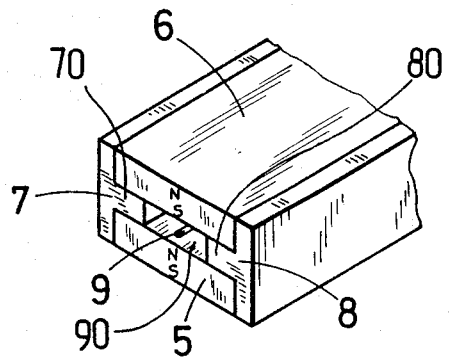
FIG. 2 is a partial perspective view of a second embodiment, having two magnetized strips.
Figure 3:
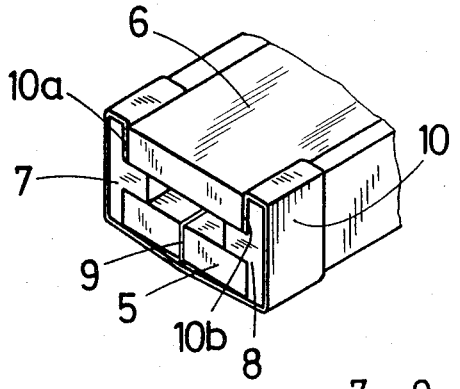
FIG. 3 shows one embodiment of the terminals.

According to the embodiment shown in FIG. 2, the fuse is formed from two flexible strips 5 and 6 formed from ferrite powder bonded by means of an elastomer, which is commercialized under the name PLASTOFERRITE. These strips are magnetized in the direction of their thickness and attract each other mutually. They are fixed face to face and maintained apart from each other in the direction of their thickness by means of two T-section insulating bars 7 and 8. Strip 5 is fixed to bars 7 and 8 by bonding, whereas strip 6 is simply held magnetically by strip 5 so as to remain removable. The legs 70 and 80 of the T-section ensure the spacing of the magnetized strips, which spacing defines the thickness of a housing 90 in which is disposed the silver wire 9. The transverse dimension of housing 90 is defined by the spacing of legs 70 and 80. At its ends, the wire 9 is fixed and connected galvanically to two terminals which may be formed as shown in FIG. 3 in which each terminal is formed by a metal strap 10 whose ends 10*a* and 10*b* are bent back around each of the insulating bars 7 and 8, the end of wire 9 being bent back under the strap. The end of wire 9 could also be welded to the strap. The upper magnetized strip allows easy reloading of the fuse.

Figure 4:
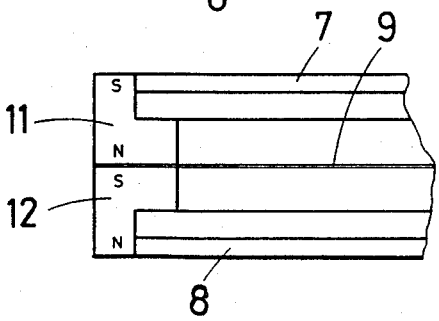
FIG. 4 shows another embodiment of the terminals.

In the embodiment shown in FIG. 4, the ends of wire 9 are fixed by nipping between two magnetized metal pieces 11 and 12 forming simutaneously plugs closing the ends of the fuse and contact terminals. Referring to FIG. 2, it will also be possible to nip wire 9 between two metal plates bonded respectively to the upper face of strip 5 and to the lower face of strip 6. So as not to attenuate the magnetic field non-ferromagnetic, preferably diamagnetic metals will be used. The ferrie strips may have for example a length of 50 mm for a width of 10 mm and a thickness of 1.8 mm with an air gap of 1.5 mm.

Figure 5:
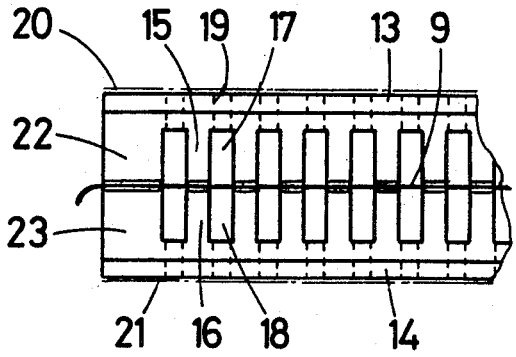
FIG. 5 is a top view of a third embodiment, one of the ferrite strips being removed.
Figure 6:
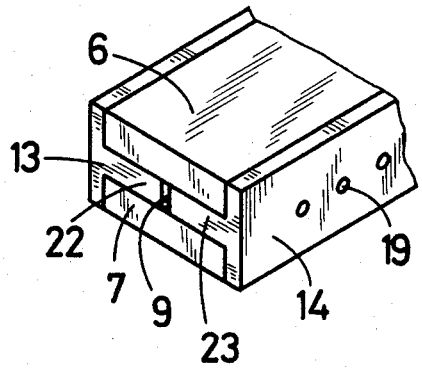
FIG. 6 is a perspective view of this third embodiment.
Figure 7:
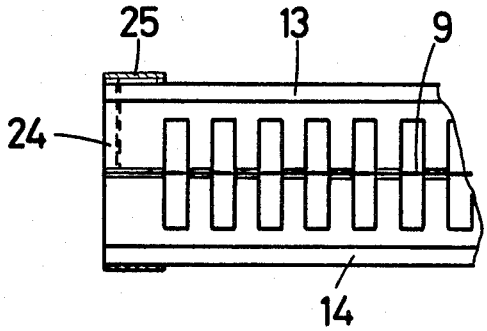
FIG. 7 illustrates one method of forming the terminals in the third embodiment.

It is possible to increase the efficiency of the effect of magnetic blowout of the electric arc by using insulating bars 13 and 14 such as shown in FIGS. 5 and 6. The legs of these insulating bars 13 and 14 are provided with teeth 15 and 16 engaging between the ferrite strips 6 and 7, these teeth forming two combs whose teeth are situated opposite each other, the gaps 17 and 18 formed between the teeth constituting arc cooling and extinction chambers. The legs and the teeth of bars 13 and 14 have a sufficient length for the fuse wire 9 to be held moreover mechanically between these teeth, which allows it to withstand more readily mechanical shocks without risk of breaking. It has in fact been noted that fuse wires of the prior art break by simple mechanical stress at their fixing point. It is moreover possible to cause the extinction chambers to communciate with the outside through holes 19 which extend them and which further promote the blowout of the arc and the expulsion of metal particles. If necesary, these holes may be closed by means of adhesive strips 20 and 21 shown with broken lines. At its ends, wire 9 is nipped between two wider teeth 22 and 23 of the insulating bars. The ends of the wire may be connected to terminals by nipping or soldering. FIG. 7 illustrates one example of connection in which the wire is bent back into a slit 24 in one of the bars and under a metal ring 25.

Figure 8:
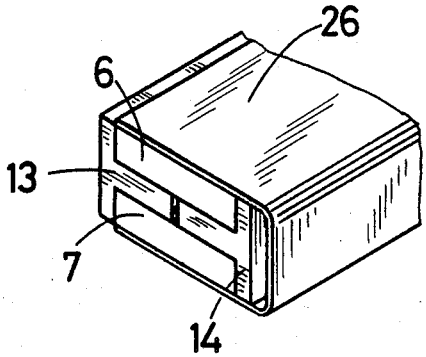
FIG. 8 shows a variation, with armature, of the third embodiment.

It is possible to considerably increase the magnetic field, i.e. the blowing-out effect in the air gap, by means of a ferromagnetic armature. Such an embodiment is shown in FIG. 8, as a variation of the embodiment shown in FIGS. 5 and 6, in which the armature is formed by a soft-iron metal sheet 26 bent into a U. With this armature, it was possible to measure a magnetic field of 1200 to 1300 Gauss against a field of 500 to 650 Gauss without armature. The forces acting in this case on the wire and the arc are relatively very high.

To sum up, the fuse of the invention presents a very high cut-off power and ensures a practically absolute protection for delicate components by its high cut-off speed, it is easy to manufacture, it may be reloadable and even cleanable.

The present invention is not limited to the embodiments which have been explicitly described, but includes the different variations and generalizations thereof contained within the scope of the following claims.

I claim:

1. A fuse comprising a conducting wire (9) capable of being destroyed by melting in the case of an excess current; at least one elongated support means formed at least partially of ferrite (1) and having a top surface, a bottom surface and a thickness between said top and bottom surfaces, magnetized in the direction of its thickness and on which said conducting wire is disposed between two terminals (3, 4) spaced apart along said support means, said wire being supported along its entire length on one of said surfaces of said support means.

2. The fuse of claim 1, comprising two ferrite support means (5, 6) assembled and spaced apart by means of two insulating material bars (7, 8) each ferrite support means being formed as an elongated member having a top surface, a bottom surface and a thickness therebetween, each said support means being magnetized in the direction of its thickness, said wire being located between said support means.

3. The fuse of claim 2, wherein the ferrite strips (5, 6) are flexible strips.

4. The fuse of claim 3, wherein one of the ferrite strips (5) is fixed by bonding to the insulating bars whereas the other (6) is held magnetically by attraction by means of the bonded strip (5).

5. The fuse of claim 2, wherein portions (70, 80) of the insulating bars situated between the ferrite strips (5, 6) are provided with teeth (15, 16) defining gaps (17, 18) forming electric-arc extinction chambers.

6. The fuse of claim 5, wherein said conducting wire is nipped between the teeth (15, 16) of the insulating bars.

7. The fuse of claim 5, wherein the bottom of the gaps (17, 18) are provided with a hole (19) situated in the extension of the gap promoting blowout of the arc and expulsion of metal particles.

8. The fuse of claim 2, wherein the ferrite strips (5, 6) are wrapped in a ferromagnetic armature (26).

* * * * *